US009625853B2

(12) United States Patent
Imai et al.

(10) Patent No.: US 9,625,853 B2
(45) Date of Patent: Apr. 18, 2017

(54) DEVELOPING ROLLER PROVIDED WITH A SHAFT WITH AN AXIAL MIDDLE PORTION HAVING A SMALL OUTER DIAMETER AND AXIAL END PORTIONS HAVING LARGE OUTER DIAMETERS AND A DEVELOPING DEVICE PROVIDED WITH THE SAME

(71) Applicants: Masashi Imai, Kasugai (JP); Marika Ogiso, Nagoya (JP)

(72) Inventors: Masashi Imai, Kasugai (JP); Marika Ogiso, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/224,276

(22) Filed: Mar. 25, 2014

(65) Prior Publication Data

US 2014/0294434 A1 Oct. 2, 2014

(30) Foreign Application Priority Data

Mar. 28, 2013 (JP) ..... 2013-069213

(51) Int. Cl.
*G03G 15/08* (2006.01)

(52) U.S. Cl.
CPC ..... *G03G 15/0818* (2013.01)

(58) Field of Classification Search
CPC ..... G03G 15/0808; G03G 15/0225; G03G 15/2053; G03G 15/0818; F16C 3/02
USPC ..... 399/279, 280, 286; 492/39
See application file for complete search history.

(56) References Cited

U.S. PATENT DOCUMENTS

| | | | | |
|---|---|---|---|---|
| 3,019,511 | A * | 2/1962 | Hornbostel | D21F 1/40 100/162 B |
| 4,042,804 | A * | 8/1977 | Moser | G03G 15/206 219/216 |
| 5,970,294 | A * | 10/1999 | Narita et al. | 399/286 |
| 7,107,681 | B2 * | 9/2006 | Yura | G03G 15/2053 29/893.33 |
| 7,203,451 | B2 * | 4/2007 | Kayahara et al. | 399/286 |
| 8,707,662 | B2 * | 4/2014 | Borsari | B29C 66/49 493/196 |
| 2007/0003330 | A1 * | 1/2007 | Lee | 399/286 |

(Continued)

FOREIGN PATENT DOCUMENTS

| | | | |
|---|---|---|---|
| JP | 2011-158887 | A | 8/2011 |
| JP | 2011-203368 | A | 10/2011 |
| KR | 20-2000-0007678 | * | 5/2000 |

OTHER PUBLICATIONS

Machine Translation of Pyun, Junwan. The Development Roller at the Image Display Unit. Oct. 7, 1998. KIPO.*

*Primary Examiner* — Gregory H Curran
(74) *Attorney, Agent, or Firm* — Merchant & Gould P.C.

(57) ABSTRACT

A developing roller configured to carry developer and extending in an axial direction includes: a hollow cylindrical rubber portion; and a shaft. The hollow cylindrical rubber portion has axial end faces. The shaft extends through the hollow cylindrical rubber portion and has a shaft portion positioned inward of the axial end faces of the hollow cylindrical rubber portion in the axial direction. The shaft portion has an axially middle portion and axial end portions positioned outward of the axially middle portion in the axial direction. The axially middle portion has an outer diameter smaller than that of each of the axial end portions.

18 Claims, 6 Drawing Sheets

(56) References Cited

U.S. PATENT DOCUMENTS

| | | | | |
|---|---|---|---|---|
| 2007/0212088 | A1* | 9/2007 | Koike et al. | 399/55 |
| 2007/0248376 | A1* | 10/2007 | Mori et al. | 399/103 |
| 2008/0318748 | A1* | 12/2008 | Akama et al. | 492/56 |
| 2009/0180802 | A1* | 7/2009 | Sato | G03G 21/1821 399/119 |
| 2010/0092205 | A1* | 4/2010 | Nishi et al. | 399/103 |
| 2011/0236064 | A1 | 9/2011 | Fujii | |
| 2012/0057897 | A1* | 3/2012 | Itabashi | G03G 15/0898 399/103 |
| 2012/0134710 | A1* | 5/2012 | Shinohara | 399/111 |
| 2014/0294433 | A1* | 10/2014 | Imai et al. | 399/103 |

* cited by examiner

DEVELOPING ROLLER PROVIDED WITH A SHAFT WITH AN AXIAL MIDDLE PORTION HAVING A SMALL OUTER DIAMETER AND AXIAL END PORTIONS HAVING LARGE OUTER DIAMETERS AND A DEVELOPING DEVICE PROVIDED WITH THE SAME

CROSS REFERENCE TO RELATED APPLICATION

This application claims priority from Japanese Patent Application No. 2013-069213 filed Mar. 28, 2013. The entire content of the priority application is incorporated herein by reference.

TECHNICAL FIELD

The present invention relates to a developing roller for supplying a developer to a photosensitive drum, and a developing device provided with the developing roller.

BACKGROUND

There is conventionally known a developing roller including a hollow cylindrical portion made of rubber and a shaft portion fitted with the cylindrical portion. More specifically, in such a developing roller, the shaft portion has an outer diameter constant in size along its axial direction. The cylindrical portion is thus uniformly supported by the shaft portion along the axial direction.

SUMMARY

However, with the above-described conventional structure, an axially middle portion of the cylindrical portion is supported by an axially middle portion of the shaft portion, which increases hardness of the axially middle portion of the cylindrical portion. This may result in failure of an intimate contact between an axially middle portion of the developing roller and an axially middle portion of a photosensitive drum. If such contact failure occurs, an appropriate amount of developer cannot be supplied to an electrostatic latent image at the axially middle portion of the photosensitive drum from the axially middle portion of the developing roller. This may causes weak concentration of developer image at a widthwise middle portion of a recording sheet.

In view of the foregoing, it is an object of the present invention to provide a developing roller capable of preventing weak concentration of a developer image at a widthwise middle portion of a recording sheet, and a developing device provided with the developing roller.

In order to attain the above and other objects, the present invention provides a developing roller configured to carry developer and extending in an axial direction. The developing roller includes: a hollow cylindrical rubber portion; and a shaft. The hollow cylindrical rubber portion has axial end faces. The shaft extends through the hollow cylindrical rubber portion and has a shaft portion positioned inward of the axial end faces of the hollow cylindrical rubber portion in the axial direction. The shaft portion has an axially middle portion and axial end portions positioned outward of the axially middle portion in the axial direction. The axially middle portion has an outer diameter smaller than that of each of the axial end portions.

According to another aspect, the present invention provides a developing device including a developing roller configured to carry developer and extending in an axial direction. The developing roller includes: a hollow cylindrical rubber portion; and a shaft. The hollow cylindrical rubber portion has axial end faces. The shaft extends through the hollow cylindrical rubber portion and has a shaft portion positioned inward of the axial end faces of the hollow cylindrical rubber portion in the axial direction. The shaft portion has an axially middle portion and axial end portions positioned outward of the axially middle portion in the axial direction. The axially middle portion has an outer diameter smaller than that of each of the axial end portions.

DETAILED DESCRIPTION

Figure 1:
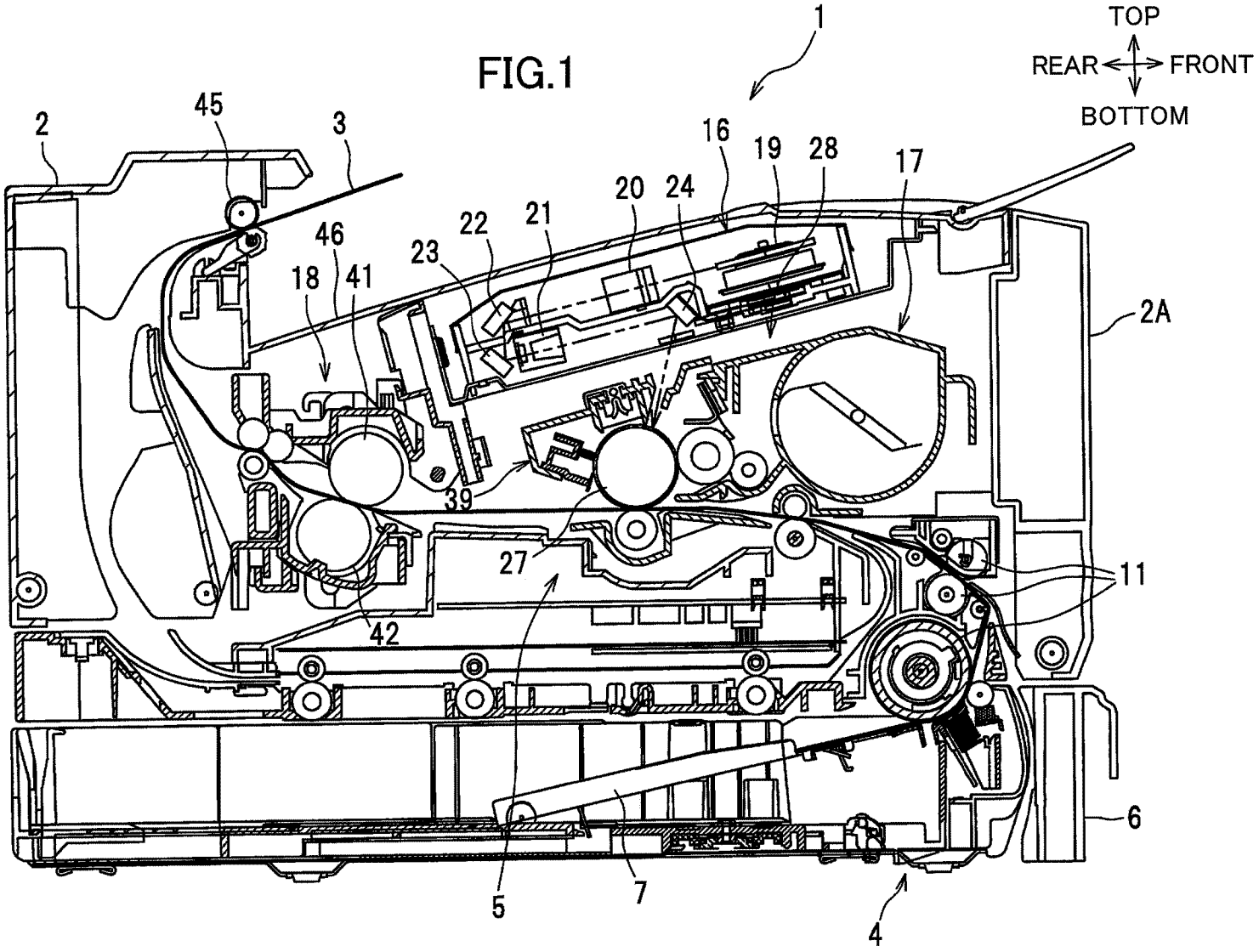
FIG. 1 is a cross-sectional view of a laser printer provided with a developing cartridge according to one embodiment of the present invention.

A laser printer provided with a developing cartridge according to one embodiment of the present invention will be described with reference to FIGS. 1 through 5, wherein like parts and components are designated by the same reference numerals to avoid duplicating description.

In the following description, the terms "upward", "downward", "upper", "lower", "above", "below", "beneath", "right", "left", "front", "rear" and the like will be used assuming that the laser printer 1 is disposed in an orientation in which it is intended to be used. More specifically, in FIG. 1, a left side and a right side are a rear side and a front side, respectively. Further, in FIG. 1, a top side and a bottom side are a top side and a bottom side, respectively.

<Overall Structure of Laser Printer>

As illustrated in FIG. 1, the laser printer 1 includes a main casing 2, and within the main casing 2, a feeder section 4 for feeding a sheet 3 and an image forming section 5 for forming an image on the sheet 3 are provided.

The feeder section 4 includes a sheet supply tray 6 detachably mounted in a bottom portion of the main casing 2, and a sheet pressing plate 7 provided in the sheet supply tray 6. The feeder section 4 further includes various rollers 11 for feeding the sheet 3 and removing paper dust from the sheet 3. In the feeder section 4, the paper pressing plate 7 presses the plurality of sheets 3 accommodated in the sheet supply tray 6 upward, and the various rollers 11 feed the plurality of sheets 3 one at a time to the image forming section 5.

The image forming section 5 includes a scanner unit 16, a process cartridge 17, and a fixing unit 18.

The scanner unit 16 is provided in an upper portion of the main casing 2 and includes a laser emitting unit (not illustrated), a rotationally-driven polygon mirror 19, lenses 20 and 21, and reflecting mirrors 22, 23 and 24. In the scanner unit 16, a laser beam passes through a path denoted by a dashed double-dotted line in FIG. 1 to be irradiated in a high-speed scan onto a surface of a photosensitive drum 27.

The process cartridge 17 is detachably mounted in the main casing 2 through an opening formed in a front wall of the main casing 2, by opening a front cover 2*a* provided at the front wall of the main casing 2 for covering the opening. The process cartridge 17 includes a developing cartridge 28 and a drum unit 39.

Figure 2:
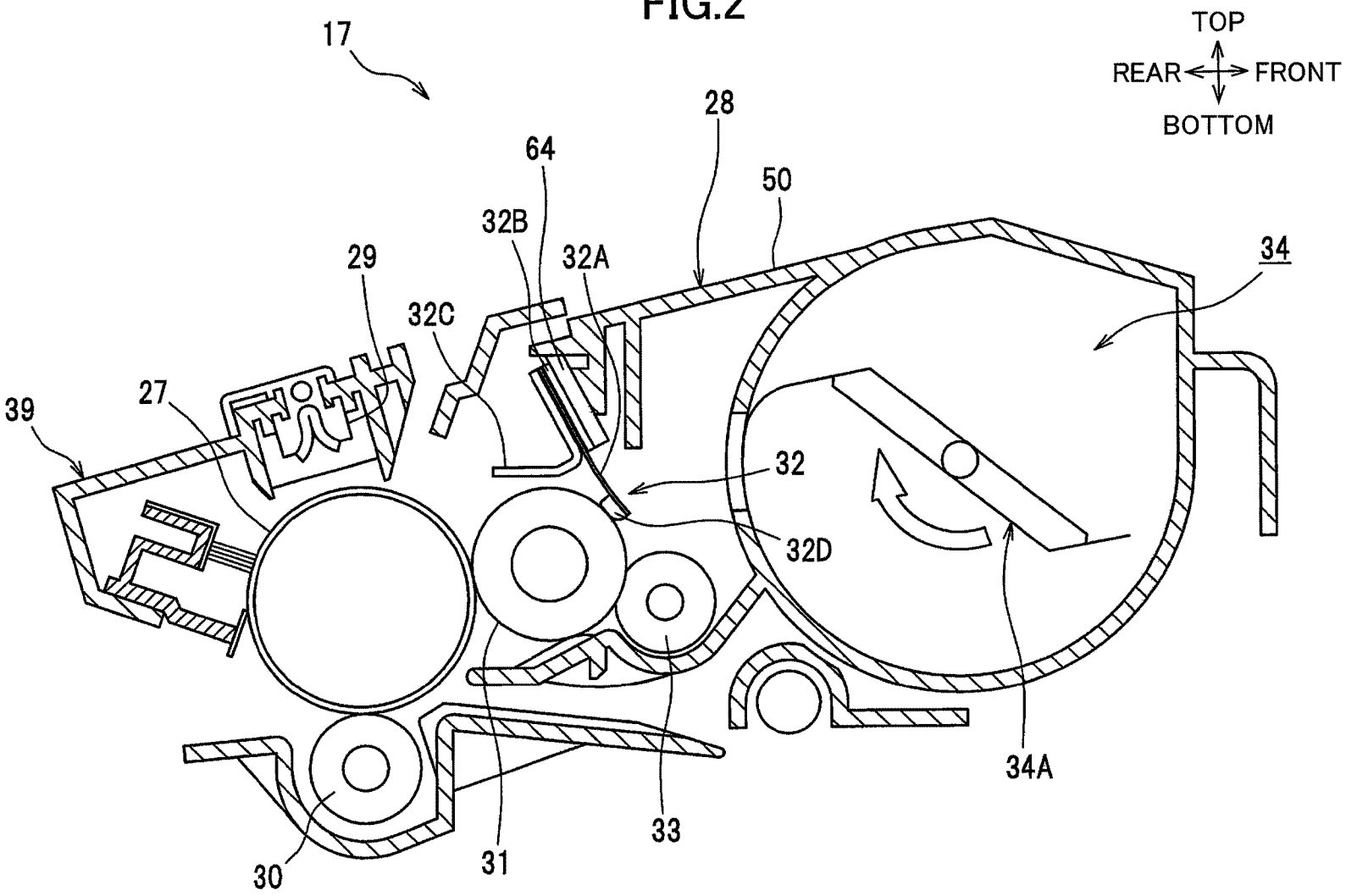
FIG. 2 is a cross-sectional view of the developing cartridge.

The developing cartridge 28 is detachably mounted in the main casing 2 in a state where the developing cartridge 28 is mounted in the drum unit 39. Incidentally, the drum unit 39 may be fixed to the main casing 2, and the developing cartridge 28 may be detachably mounted in the drum unit 39 fixed to the main casing 2. As illustrated in FIG. 2, the developing cartridge 28 includes a developing roller 31, a layer thickness regulating blade 32, a supply roller 33, and a toner chamber 34.

In the developing cartridge 28, toner contained in the toner chamber 34 is agitated by an agitator 34A and is then supplied to the developing roller 31 by the supply roller 33. At this time, the toner is positively tribo-charged between the supply roller 33 and the developing roller 31. Thereafter, as the developing roller 31 rotates, the toner carried on the developing roller 31 enters between the layer thickness regulating blade 32 and the developing roller 31, and the layer thickness regulating blade 32 regulates the thickness of the toner carried on the developing roller 31, while the toner is further tribo-charged.

The drum unit 39 includes the photosensitive drum 27, a scorotron charger 29, and a transfer roller 30. In the drum unit 39, the surface of the photosensitive drum 27 is uniformly positively charged by the scorotron charger 29 and is thereafter exposed to the laser beam emitted from the scanner unit 16 in a high-speed scan. As a result, electric potential at the exposed portion decreases and thus an electrostatic latent image based on image data is formed on the surface of the photosensitive drum 27.

Subsequently, the toner carried on the developing roller 31 is supplied, by rotation of the developing roller 31, to the electrostatic latent image formed on the surface of the photosensitive drum 27, whereby a toner image is formed on the surface of the photosensitive drum 27. Thereafter, while the sheet 3 is fed between the photosensitive drum 27 and the transfer roller 30, the toner image carried on the surface of the photosensitive drum 27 is transferred onto the sheet 3.

As illustrated in FIG. 1, the fixing unit 18 includes a heating roller 41 and a pressure roller 42. The pressure roller 42 is disposed opposite to the heating roller 41 and applies pressure to the heating roller 41. In the fixing unit 18 with this configuration, the toner image transferred onto the sheet 3 is thermally fixed to the sheet 3 while the sheet 3 passes between the heating roller 41 and the pressure roller 42. The sheet 3 onto which the toner image has been thermally fixed is discharged to a discharge tray 46 by a discharge roller 45 disposed downstream of the fixing unit 18 in a sheet conveyance direction.

<Detailed Structure of Developing Cartridge>

Figure 3:
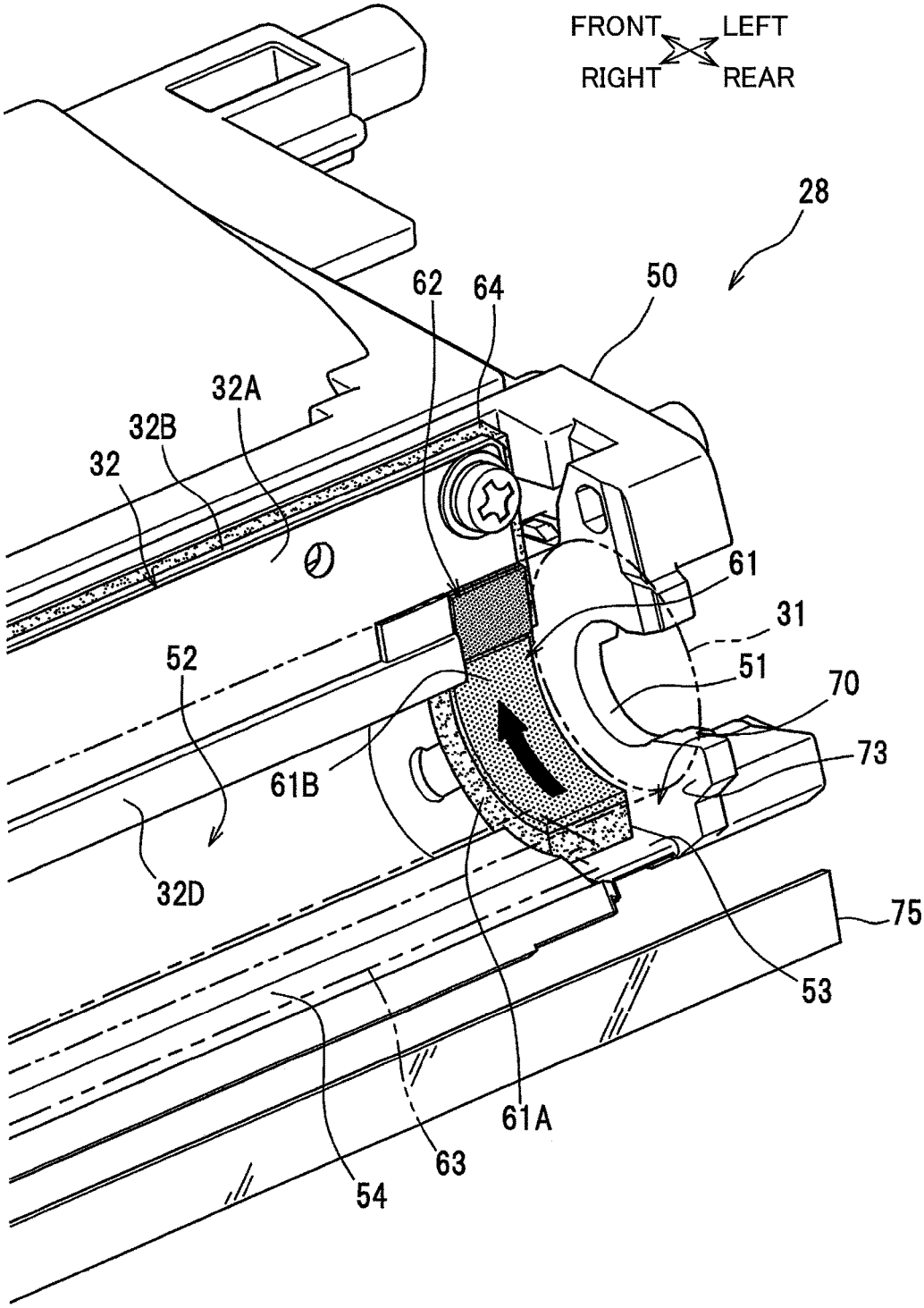
FIG. 3 is an enlarged partial perspective view of the developing cartridge, illustrating a structure around a supply port.

Next, a configuration of the developing cartridge 28 will be described in detail. Since the developing cartridge 28 has left-right symmetry, only a left portion of the developing cartridge 28 is illustrated in FIG. 3, whereas a right portion thereof is omitted. Further, FIG. 3 illustrates the developing cartridge 28 in a state where the developing roller 31, the supply roller 33 and a reinforcing plate 32B (described later) have been removed from a casing 50 (described later).

As illustrated in FIG. 3, the developing cartridge 28 further includes the casing 50, a pair of blade seals 62, a pair of side seals 61, and a lower film 63.

When the developing roller 31 mounted in the casing 50 rotates, an upper portion of the developing roller 31 is in sliding contact with the layer thickness regulating blade 32 and the pair of blade seals 62, left and right end portions of the developing roller 31 are in sliding contact with the pair of side seals 61, and a lower portion of the developing roller 31 is in sliding contact with the lower film 63.

The casing 50 accommodates toner therein. The casing 50 has a pair of outer walls 73, a supply port 52, a pair of side seal attachment surfaces 53, and a support portion 54.

The outer walls 73 each have a shaft support portion 51 for rotatably supporting the developing roller 31 through a shaft support member (not illustrated).

The supply port 52 is provided for supplying toner from the toner chamber 34 inside the casing 50 to the developing roller 31. The supply port 52 is formed in a rectangular shape that is elongated in an axial direction of the developing roller 31. The supply port 52 has an upper portion to which the layer thickness regulating blade 32 is fixed. The layer thickness regulating blade 32 protrudes downward from the upper portion of the supply port 52.

The side seal attachment surfaces 53 are provided one each on left and right sides of the supply port 52. The side seal 61 is attached to the side seal attachment surface 53. The side seal attachment surface 53 is substantially an arcuate surface in a side view.

The support portion 54 supports the lower film 63. The support portion 54 is disposed below the supply port 52. The support portion 54 extends in the axial direction of the developing roller 31, and protrudes toward a developing roller 31 side further than the side seal attachment surfaces 53.

As illustrated in FIG. 2, the layer thickness regulating blade 32 includes a blade metal plate 32A, reinforcing plates 32B and 32C, and a pressing member 32D.

As illustrated in FIG. 3, the pressing member 32D regulates the thickness of toner supplied onto an outer peripheral surface of the developing roller 31 with the outer peripheral surface slidingly contacting the pressing member 32D. The pressing member 32D is made of a material such as rubber, more specifically, foamed rubber.

The pressing member 32D extends in a left-right direction (i.e. axial direction of the developing roller 31) and fixed to a lower end portion of the blade metal plate 32A. The pressing member 32D has a left-right length that is smaller than that of the blade metal plate 32A. The pressing member 32D has a lower edge linearly extending in the left-right direction.

Each blade seal 62 has a rectangular shape. The blade seals 62 are attached onto the blade metal plate 32A at positions adjacent to the pressing member 32D. More specifically, the blade seals 62 are provided one each on outer left and right sides of the pressing member 32D. Each blade seal 62 has a configuration similar to that of the side seal 61. Thus, description on the configuration of the blade seal 62 is omitted.

As illustrated in FIG. 2, the layer thickness regulating blade 32 with the above-described configuration is fixed to the casing 50 at an upper portion of the blade metal plate 32A interposed between the reinforcing plates 32B and 32C. The blade metal plate 32A applies a biasing force to the pressing member 32D and the blade seals 62 both disposed at the lower end portion of the blade metal plate 32A, while the developing roller 31 slidingly contacts the pressing member 32D and the blade seals 62.

A blade back seal 64 is provided at a position between the layer thickness regulating blade 32 and the casing 50. More specifically, the blade back seal 64 is formed in substantially an inverted U-shape surrounding the upper portion of the supply port 52. Left and right end portions of the blade back seal 64 are attached to upper portions of the left and right side seal attachment surfaces 53, respectively.

As illustrated in FIG. 3, each side seal 61 is provided for preventing toner from leaking through a gap between the casing 50 and the left-right end portion of the developing roller 31 (i.e. axial end portion of a cylindrical portion 80, described later). Each side seal 61 is provided between the left-right end portion of the developing roller 31 and the side seal attachment surface 53.

More specifically, each side seal 61 is disposed below and adjacent to the blade seal 62, and also disposed on an outer side of the support portion 54 in the left-right direction.

The side seal 61 includes a base portion 61A having resiliency, and a layered portion 61B. The base portion 61A has a surface on the developing roller 31 side, and the layered portion 61B is layered on the surface of the base portion 61A. The base portion 61A is made of resiliently deformable material, such as urethane sponge, which is softer than a material of which the layered portion 61B is made. The base portion 61A is attached to the side seal attachment surface 53 by a double-stick tape or an adhesive, for example.

The layered portion 61B is made of a felt material thinner than the base portion 61A. The layered portion 61B is attached onto the base portion 61A by a double-stick tape, for example.

The lower film 63 is a sheet-like member that is made of resin, such as polyethylene terephthalate, and extends in the axial direction of the developing roller 31. The lower film 63 has a left-right length longer than that of the support portion 54. In a state where the lower film 63 is attached to the support portion 54, both left and right end portions of the lower film 63 protrude from the support portion 54. The portions of the lower film 63 protruding from the support portion 54 are superposed with the side seals 61, respectively.

The casing 50 is further provided with a pair of developer receiving portions 70 each disposed on a rear side of the side seal 61. The developer receiving portion 70 is formed in a concave shape having a top opening. More specifically, the developer receiving portion 70 is defined by the side seal attachment surface 53, the support portion 54, the outer wall 73 disposed on an outer left-right side of the side seal attachment surface 53, the side seal 61, and a flexible sheet-like member 75. The sheet-like member 75 is attached to a rear end portion of the casing 50 and extends along the rear end portion of the casing 50. If toner deposited on the blade seal 62 is captured by the developing roller 31 to be conveyed toward the side seal 61, the toner can be received by the developer receiving portion 70 even if the toner is scraped off from the developing roller 31 by the edge of the side seal 61. Hence, the developer receiving portion 70 can prevent the toner leaking from the developing cartridge 28.

Next, the developing roller 31 according to the embodiment of the present invention will be described in detail.

Figure 4:
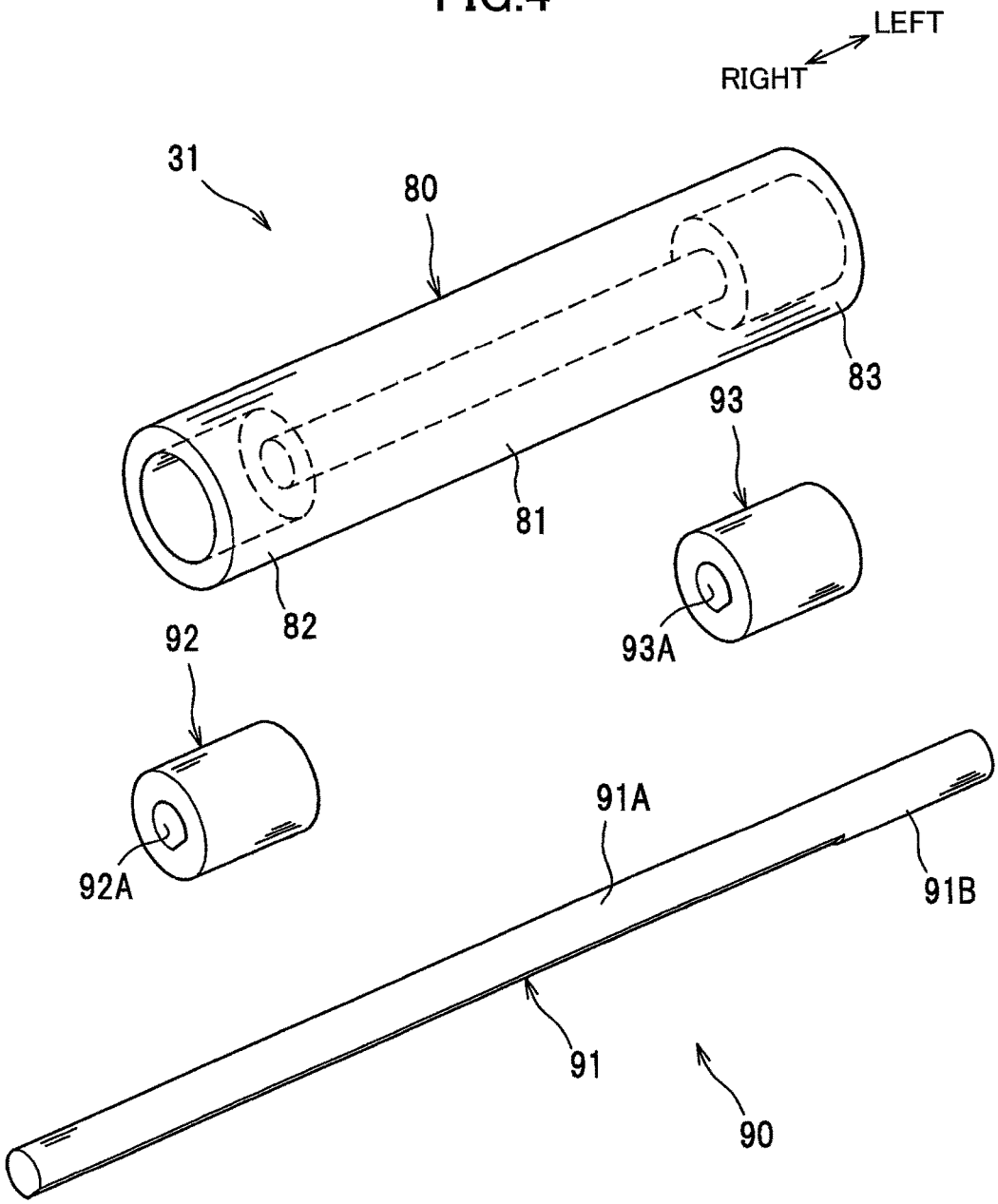
FIG. 4 is an exploded perspective view of a developing roller provided in the developing cartridge.
Figure 5:
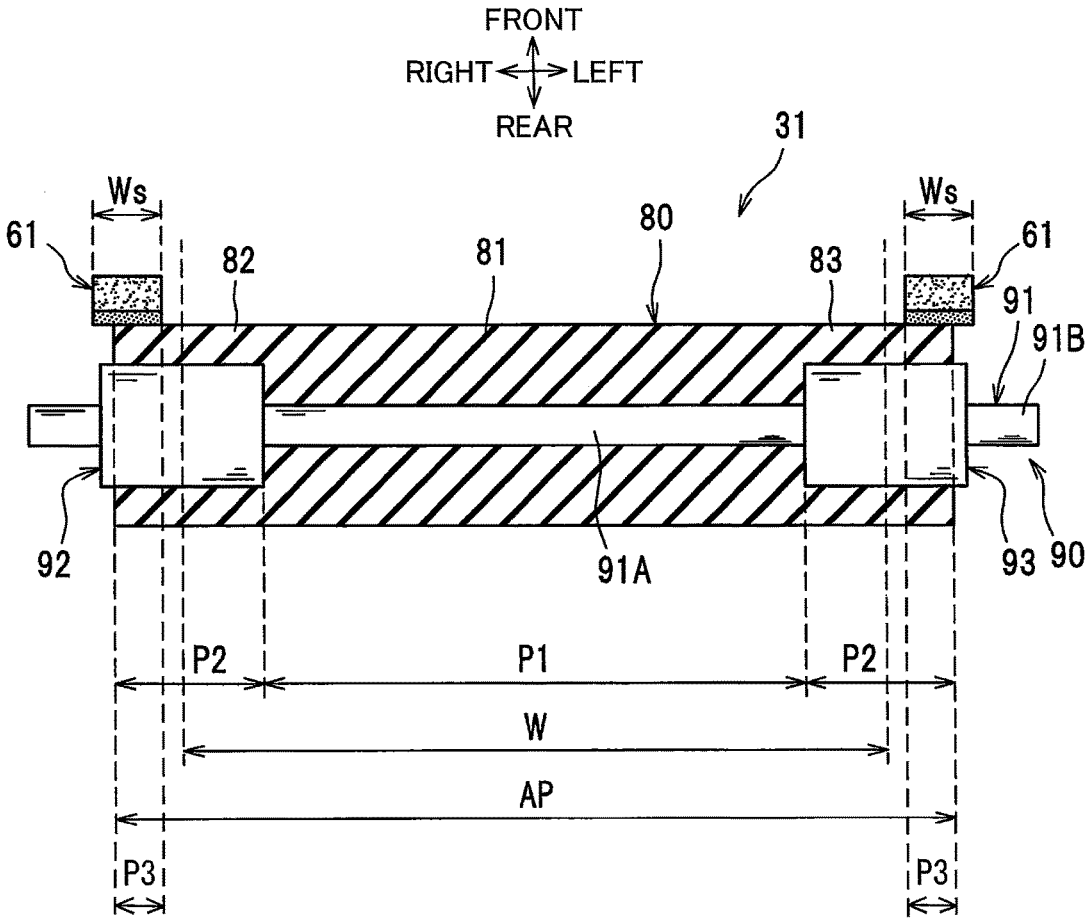
FIG. 5 is a cross-sectional view of the developing roller and a pair of side seals.

The developing roller is configured to carry toner thereon. As illustrated in FIGS. 4 and 5, the developing roller 31 includes a hollow cylindrical portion 80 made of rubber, and a rotation shaft 90 made of metal. The hollow cylindrical portion 80 includes a thick-wall portion 81, a first thin-wall portion 82, and a second thin-wall portion 83. The thick-wall portion 81 is cylindrical in shape and provided at a middle portion of the hollow cylindrical portion 80 in the left-right direction (i.e. axial direction). The first thin-wall portion 82 is cylindrical in shape and provided at one end portion (right end portion) of the thick-wall portion 81. The second thin-wall portion 83 is cylindrical in shape and provided at another end portion (left end portion) of the thick-wall portion 81.

The thick-wall portion 81 has an outer diameter equal to outer diameters of the first and second thin-wall portions 82, 83, and an inner diameter smaller than inner diameters of the first and second thin-wall portions 82, 83. That is, the thick-wall portion 81 has a wall thickness larger than wall thicknesses of the first and second thin-wall portions 82, 83. The thick-wall portion 81 has a radially inward protruding length from inner peripheral surfaces of the first and second thin-wall portions 82, 83. With this configuration, stepped portions are provided between the thick-wall portion 81, and the first and second thin-wall portions 82, 83.

The rotation shaft 90 includes a shaft member 91, a first large-diameter member 92, and a second large-diameter member 93. The shaft member 91 has a left-right length larger than that of the hollow cylindrical portion 80. The shaft member 91 has an outer diameter substantially equal to the inner diameter of the thick-wall portion 81. This allows the shaft member 91 to be fitted with the cylindrical thick-wall portion 81.

The shaft member 91 has an engagement portion 91A having a generally D-shaped cross-section, and a columnar portion 91B continuously extending from one end (left end) of the engagement portion 91A. The shaft member 91, which is configured of the engagement portion 91A having a generally D-shaped cross-section and the columnar portion 91B, is formed by cutting out a portion from an outer periphery of an elongated columnar member.

Incidentally, the engagement portion 91A preferably has a cross-sectional shape whose arcuate length is larger than one-half of a circumferential length of the columnar portion 91B. With this configuration, one end portion of the engagement portion 91A having a generally D-shaped cross-section can be reliably supported by the shaft support member (not illustrated).

The first and second large-diameter members 92, 93 are hollow cylindrical in shape, and provided separately from the shaft member 91. The first and second large-diameter members 92, 93 have outer diameters larger than the outer diameter of the shaft member 91. Further, the outer diameters of the first and second large-diameter members 92, 93 are substantially equal to the inner diameters of the first and second thin-wall portions 82, 83. This allows the first and second large-diameter members 92, 93 to be fitted with and retained in the first and second thin-wall portions 82, 83, respectively.

Further, the first and second large-diameter members 92, 93 each have a center portion formed with a thorough-hole 92A, 93A, having generally D-shaped cross-section, through which the engagement portion 91A having a generally D-shaped cross-section extends. In a state where the first and second large-diameter members 92, 93 are assembled to the shaft member 91, the engagement portion 91A can be engaged with the thorough-holes 92A, 93A in a circumferential direction, whereby the shaft member 91 can rotate together with the first and second large-diameter members 92, 93. Further, in a state where the first and second large-diameter members 92, 93 are assembled to the shaft member 91, stepped portions are provided between the shaft member 91 and the first and second large-diameter members 92, 93.

In manufacturing the developing roller 31 with the above-described configuration, firstly, the first large-diameter member 92 is fitted with the first thin-wall portion 82 of the hollow cylindrical portion 80. At this time, an end face (left end face) of the first large-diameter member 92 is brought into abutment with an end face (right end face) of the thick-wall portion 81, thereby easily positioning the first large-diameter member 92 relative to the hollow cylindrical portion 80 in the axial direction.

Next, the second large-diameter member 93 is attached to the engagement portion 91A of the shaft member 91. At this time, an end face (left end face) of the second large-diameter member 93 is brought into abutment with an end face (right end face) of the columnar portion 91B, thereby easily positioning the second large-diameter member 93 relative to the shaft member 91 in the axial direction.

Thereafter, the shaft member 91 to which the second large-diameter member 93 has been attached is inserted, thorough the thin-wall portion 83 of the hollow cylindrical portion 80, into the thorough-hole 92A of the first large-diameter member 92 retained in the first thin-wall portion 82 of the hollow cylindrical portion 80. Subsequently, the second large-diameter member 93 is pushed into the thin-wall portion 83 of the hollow cylindrical portion 80 together with the shaft member 91 to be fitted with the thin-wall portion 83.

Then, a protruding portion of the engagement portion 91A axially outwardly protruding from the first large-diameter member 92 is fixed to the first large-diameter member 92 by welding or adhesive-bonding, thereby completing the manufacturing process of the developing roller 31.

The developing roller 31 manufactured as described above has a shaft portion AP as illustrated in FIG. 5. More specifically, the shaft portion AP is a portion of the rotation shaft 90 extending through the hollow cylindrical portion 80 and positioned inward of each axial end face of the hollow cylindrical portion 80 in the axial direction. An axially middle portion (i.e. engagement portion 91A) of the shaft portion AP has an outer diameter smaller than outer diameters of axial end portions (i.e. first and second large-diameter members 92, 93) of the shaft portion AP. In other words, the outer diameter of the shaft portion AP changes its size at a position within an image formable region W. More specifically, the stepped portions of the rotation shaft 90 between the engagement portion 91A and the first and second large-diameter members 92, 93, which are positions providing changes in size of the outer diameter of the shaft portion AP, are positioned inward of the image formable region W in the axial direction. Here, the image formable region W implies a width (left-right length) of the sheet 3 having a maximum width among a plurality of types of the sheet 3 printable in the laser printer 1.

Further, the shaft portion AP includes a first columnar portion P1 provided at an axially middle portion thereof, and second columnar portions P2 provided one each at an axially end portion thereof. That is, the second columnar portions P2 are positioned on both sides of the first columnar portion P1 in the axial direction. Each second columnar portion P2 has an outer diameter larger than that of the first columnar portion P1.

A portion of the engagement portion 91A positioned between the first large-diameter member 92 and the second large-diameter member 93 constitutes the first columnar portion P1. A portion of the first large-diameter member 92 positioned inward of the axial end face of the hollow cylindrical portion 80 in the axial direction and a portion of the engagement portion 91A fitted with the portion of the first large-diameter member 92 constitute one of the second columnar portions P2. A portion of the second large-diameter member 93 positioned inward of the axial end face of the hollow cylindrical portion 80 in the axial direction and a portion of the engagement portion 91A fitted with the portion of the second large-diameter member 93 constitute the other of the second columnar portions P2.

The shaft member 91 provides an outer peripheral surface of the first columnar portion P1. The first large-diameter member 92 and the second large-diameter member 93 provide outer peripheral surfaces of the second columnar portions P2.

Since the axially middle portion of the shaft portion AP has an outer diameter smaller than that of each axial end portions of the shaft portion AP, and the thick-wall portion 81 is provided at the axially middle portion of the hollow cylindrical portion 80, the axially middle portion of the hollow cylindrical portion 80 is more deformable than each axially end portions of the hollow cylindrical portion 80. Because of easily deformable nature of the axially middle portion of the hollow cylindrical portion 80, an intimate contact between the axially middle portion of the hollow cylindrical portion 80 and the photosensitive drum 27 can be provided. Thus, an appropriate amount of toner can be provided to the electrostatic latent image at an axially middle portion of the photosensitive drum 27 through an axially middle portion of the developing roller 31. This can reduce the problem of weak concentration of the toner image at a widthwise middle portion of the sheet 3.

Further, as illustrated in FIG. 5, a portion of the shaft portion AP has an outer diameter constant in size at a position within a width Ws of each side seal 61. More specifically, an outer peripheral surface of each second columnar portion P2 has a portion overlapping with the side seal 61 as viewed in a radial direction of the developing roller 31, and this overlapping portion is arranged parallel to the axial direction. In other words, the shaft portion AP has aligned portions P3 aligned with the pair of side seals 61 in the axial direction, and the outer diameter of each aligned portion P3 is constant in size in the axial direction. With this arrangement, a nip pressure between each side seal 61 and each axial end portion of the hollow cylindrical portion 80 can be maintained along the axial direction. Hence, sealability between the side seals 61 and the axial end portions of the hollow cylindrical portion 80 can be enhanced.

In addition to the above-described operational advantages, the following operational advantage can be obtained.

The shaft member 91 providing the outer peripheral surface of the first columnar portion P1 is provided separately from the first and second large-diameter members 92, 93 each providing the outer peripheral surface of the second columnar portion P2. The shaft portion AP is provided by assembling the first and second large-diameter members 92, 93 manufactured separately from the shaft member 91 to the shaft member 91, and each member has a simple configuration. This facilitates manufacturing of the shaft portion AP, compared with a case where a portion of an axially middle portion of a single columnar member is cut out to integrally form a first columnar portion and second columnar portions.

Modifications

Various modifications are conceivable. In the following description, only parts differing from those of the embodiment will be described in detail.

First Modification

Figure 6:
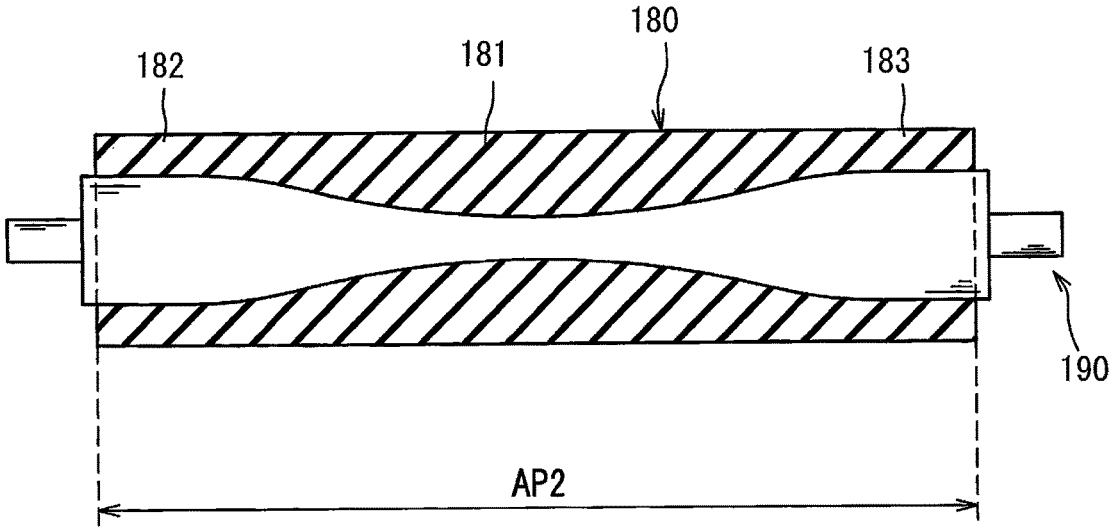
FIG. 6 is a cross-sectional view of a developing roller according to a first modification of the present invention.

In the above-described embodiment, the outer peripheral surface of the shaft portion AP has stepped portions. Thus, the size of the outer diameter of the shaft portion AP is drastically changed at prescribed positions (i.e. stepped portions). However, according to a first modification illustrated in FIG. 6, a shaft portion AP2 can provide a gradual decrease in size of its outer diameter toward an axially middle portion of the shaft portion AP2 from each axial end portion thereof. In this case, as illustrated in FIG. 6, a hollow cylindrical portion 180 including a thick-wall portion 181, a first thin-wall portion 182, and a thin-wall portion 183 may have an inner peripheral surface shaped in conformity with an outer peripheral surface of the shaft portion AP2. That is, the hollow cylindrical portion 180 may have an inner diameter gradually increasing in size toward an axially middle portion of the hollow cylindrical portion 180 from each axial end portion thereof. Incidentally, with this structure, a rotation shaft 190 is fitted with the hollow cylindrical portion 180 while deforming the hollow cylindrical portion 180 made of rubber, whereby the rotation shaft 190 is assembled to the hollow cylindrical portion 180.

Second Modification

Figure 7:
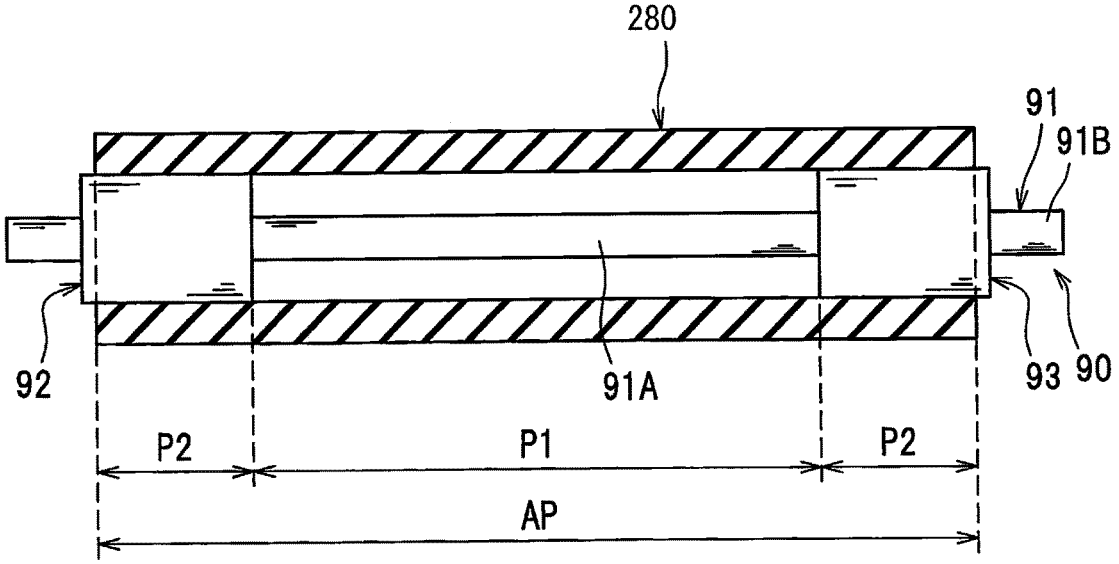
FIG. 7 is a cross-sectional view of a developing roller according to a second modification of the present invention.

In the above-described embodiment, the first columnar portion P1 of the shaft portion AP is in contact with the axially middle portion of the hollow cylindrical portion 80 (i.e. thick-wall portion 81). However, according to a second modification illustrated in FIG. 7, a hollow cylindrical portion 280 can be arranged spaced apart from the first columnar portion P1. More specifically, the hollow cylindrical portion 280 has a wall thickness constant in the axial direction. Separation of an axially middle portion of the hollow cylindrical portion 280 from the first columnar portion P1 forms a space between the axially middle portion of the hollow cylindrical portion 280 and the first columnar portion P1.

In this case, in order to fix the axial positions of the first and second large-diameter members 92, 93 relative to the hollow cylindrical portion 280, a projection can be formed at one of an outer peripheral surface of the first large-diameter member 92 (or the second large-diameter member 93) and an inner peripheral surface of the hollow cylindrical portion 280, and a recess in engagement with the projection can be formed at remaining one of the outer peripheral surface of the first large-diameter member 92 (or the second large-diameter member 93) and the inner peripheral surface of the hollow cylindrical portion 280. Further, in this case, reduction of the contact area between the rotation shaft 90 and the hollow cylindrical portion 280 may cause slippage of the rotation shaft 90 with respect to the hollow cylindrical portion 280. In order to prevent the slippage between the hollow cylindrical portion 280 and the rotation shaft 90, the inner peripheral surfaces of axial end portions of the hollow cylindrical portion 280 and the outer peripheral surfaces of the first and second large-diameter members 92, 93 may be polygonal in shape, rather than cylindrical in shape.

Other Modifications

Further, the above-described developing roller and the above-described developing device are applied to the laser printer 1. However, these can be applied to an image forming device such as a copying machine and a multifunction apparatus other than the laser printer.

Further, in the above-described developing device, the developing cartridge 28 integrally includes the toner chamber 34. However, another developing cartridge is available in which a toner cartridge having a toner chamber is attachable to and detachable from a developing cartridge.

Further, in the above-described embodiment, the side seal and the blade seal provide a bilayer structure. However, a single layer or not less than three multiple layers are also available as such seals.

While the present invention has been described in detail with reference to the embodiment thereof, it would be apparent to those skilled in the art that various changes and modifications may be made therein without departing from the spirit of the present invention.

What is claimed is:

1. A process cartridge comprising:

a drum cartridge including a photosensitive drum; and a developing cartridge configured to be detachably mountable in the drum cartridge, the developing cartridge including a developing roller, wherein the developing roller being in pressure contact with the photosensitive drum in a state where the developing cartridge is mounted in the drum cartridge, the developing roller extends in an axial direction, the developing roller comprising:

a shaft extending in the axial direction, the shaft including:

a first columnar portion having a uniform outer diameter along its entire length in the axial direction;

a second columnar portion having a uniform outer diameter along its entire length in the axial direction; and a third columnar portion having a uniform outer diameter along its entire length in the axial direction, the third columnar portion being positioned between the first columnar portion and the second columnar portion in the axial direction, the diameter of the third columnar portion being smaller than the outer diameter of the first columnar portion and the outer diameter of the second columnar portion; and a hollow cylindrical rubber covering an outer peripheral surface of the first columnar portion, an outer peripheral surface of the second columnar portion, and an outer peripheral surface of the third columnar portion, the outer peripheral surface of the first columnar portion and the outer peripheral surface of the second columnar portion being arranged in contact with an inner peripheral surface of the hollow cylindrical rubber, the outer peripheral surface of the third columnar portion being arranged spaced apart from the inner peripheral surface of the hollow cylindrical rubber, and wherein the inner peripheral surface of the hollow cylindrical rubber and the outer peripheral surface of the third columnar portion defines a first distance in a radial direction of the third columnar portion when the developing cartridge has been mounted in the drum cartridge, and the inner peripheral surface of the hollow cylindrical rubber and the outer peripheral surface of the third columnar portion defines a second distance in the radial direction when the developing cartridge has been detached from the drum cartridge, the first distance being smaller than the second distance.

2. The process cartridge according to claim 1, wherein the shaft further includes:

a fourth columnar portion connected to the first columnar portion and provided on the opposite side of the third columnar portion with respect to the first columnar portion, the fourth columnar portion having an outer diameter equal to the outer diameter of the first columnar portion; and a fifth columnar portion connected to the second columnar portion and provided on the opposite side of the third columnar portion with respect to the second columnar portion, the fifth columnar portion having an outer diameter equal to the outer diameter of the second columnar portion;

wherein an outer peripheral surface of the fourth columnar portion and an outer peripheral surface of the fifth columnar portion being exposed to an atmosphere.

3. The process cartridge according to claim 2, wherein the hollow cylindrical rubber has an outer peripheral surface, the outer peripheral surface of the hollow cylindrical rubber having one end and another end in the axial direction, wherein the developing cartridge further comprises a first seal and a second seal, the first seal contacting the one end of the outer peripheral surface of the hollow cylindrical rubber in the radial direction and configured to capture toner deposited on the one end, the second seal contacting the another end of the outer peripheral surface of the hollow cylindrical rubber in the radial direction and configured to capture toner deposited on the another end, and wherein the first columnar portion, the second columnar portion, the fourth columnar portion and the fifth columnar portion are made of metal.

4. The process cartridge according to claim 3, wherein the first seal is arranged spaced apart from the fourth columnar portion in the radial direction and the second seal is arranged spaced apart from the fifth columnar portion in the radial direction.

5. The process cartridge according to claim 4, wherein the first columnar portion has a projection formed on the outer peripheral surface of the first columnar portion, and wherein the hollow cylindrical rubber has a recess formed in the inner peripheral surface of the hollow cylindrical rubber, the projection being fitted in the recess.

6. The process cartridge according to claim 4, wherein the first columnar portion has a recess formed in the outer peripheral surface of the first columnar portion, and wherein the hollow cylindrical rubber has a projection formed on the inner peripheral surface of the hollow cylindrical rubber, the projection being fitted in the recess.

7. The process cartridge according to claim 3, wherein the shaft further includes:

a sixth columnar portion connected to the fourth columnar portion and provided on the opposite side of the third columnar portion with respect to the first and fourth columnar portions, the sixth columnar portion having an outer diameter smaller than the outer diameter of the first columnar portion; and a seventh columnar portion connected to the fifth columnar portion and provided on the opposite side of the third columnar portion with respect to the second and fifth columnar portions, the seventh columnar portion having an outer diameter smaller than the outer diameter of the second columnar portion, and wherein an outer peripheral surface of the sixth columnar portion and an outer peripheral surface of the seventh columnar portion are exposed to an atmosphere.

8. The process cartridge according to claim 4, wherein a length of the first columnar portion in the axial direction is longer than a length of the first seal in the axial direction.

9. A process cartridge comprising:

a drum cartridge including a photosensitive drum; and a developing cartridge configured to be detachably mountable in the drum cartridge, the developing cartridge including a developing roller, wherein the developing roller is in pressure contact with the photosensitive drum in a state where the developing cartridge is mounted in the drum cartridge, the developing roller extending in an axial direction, the developing roller comprising:

a rubber; and a shaft extending in the axial direction, the shaft including:

a shaft portion covered with the rubber and positioned inward of end faces of the rubber in the axial direction, the shaft portion providing a gradual decrease in size of its outer diameter toward an axially middle portion thereof from each of axial end portions, the shaft portion including:

a first columnar portion constituting one of the axial end portions of the shaft portion;

a second columnar portion constituting the other end of the axial end portions of the shaft portion; and a curved portion including the axially middle portion of the shaft portion and having a curved shape in cross-section taken along a plane perpendicular to the axial direction between the first columnar portion and the second columnar portion, the curved portion having an outer diameter smaller than an outer diameter of the first columnar portion, and the outer diameter of the curved portion being smaller than an outer diameter of the second columnar portion;

a third columnar portion connected to the first columnar portion and provided on the opposite side of the curved portion with respect to the first columnar portion, the third columnar portion having an outer diameter equal to the outer diameter of the first columnar portion; and a fourth columnar portion connected to the second columnar portion and provided on the opposite side of the curved portion with respect to the second columnar portion, the fourth columnar portion having an outer diameter equal to the outer diameter of the second columnar portion, and wherein the rubber covers an outer peripheral surface of the first columnar portion, an outer peripheral surface of the second columnar portion and an outer peripheral surface of the curved portion, wherein an outer peripheral surface of the third columnar portion and an outer peripheral surface of the fourth columnar portion are exposed to an atmosphere, wherein a thickness of the rubber at the curved portion is thicker than a thickness of the rubber at the first columnar portion, and wherein a thickness of the rubber at the curved portion includes a first thickness when the developing cartridge has been mounted in the drum cartridge and the photosensitive drum is in pressure contact with the developing roller, and a second thickness when the developing cartridge has been detached from the drum cartridge, the first thickness being thinner than the second thickness.

10. The process cartridge according to claim 9, wherein the rubber has an outer peripheral surface, the outer peripheral surface of the rubber having one end and another end in the axial direction, wherein the developing cartridge further comprises a first seal and a second seal, the first seal contacting the one end of the outer peripheral surface of the rubber in a radial direction of the rubber and configured to capture toner deposited on the one end, the second seal contacting the another end of the outer peripheral surface of the rubber in the radial direction and configured to capture toner deposited on the another end, and wherein the first columnar portion, the second columnar portion, the third columnar portion, and the fourth columnar portion are made of metal.

11. The process cartridge according to claim 10, wherein the first seal is arranged spaced apart from the third columnar portion in the radial direction and the second seal is arranged spaced apart from the fourth columnar portion in the radial direction.

12. The process cartridge according to claim 11, wherein the first columnar portion has a projection formed on the outer peripheral surface of the first columnar portion, and wherein the rubber has a recess formed in the inner peripheral surface of the rubber, the projection being fitted in the recess.

13. The process cartridge according to claim 11, wherein the first columnar portion has a recess formed in the outer peripheral surface of the first columnar portion, and wherein the rubber has a projection formed on the inner peripheral surface of the rubber, the projection being fitted in the recess.

14. The process cartridge according to claim 10, wherein the curved portion includes a first curved portion that is closer to the first columnar portion than to the second columnar portion, and wherein the thickness of the rubber at the first curved portion is gradually thicker in a direction from the first columnar portion toward the second columnar portion.

15. The process cartridge according to claim 10, wherein the curved portion includes a second curved portion that is closer to the second columnar portion than to the first columnar portion, and wherein the thickness of the rubber at the second curved portion is gradually thinner in a direction from the first columnar portion toward the second columnar portion.

16. The process cartridge according to claim 10, wherein the shaft further includes:

a fifth columnar portion connected to the third columnar portion and provided on the opposite side of the curved portion with respect to the first and third columnar portions, the fifth columnar portion having an outer diameter smaller than the outer diameter of the first columnar portion; and a sixth columnar portion connected to the fourth columnar portion and provided on the opposite side of the curved portion with respect to the second and fourth columnar portions, the sixth columnar portion having an outer diameter smaller than the outer diameter of the second columnar portion, and wherein an outer peripheral surface of the fifth columnar portion and an outer peripheral surface of the sixth columnar portion are exposed to an atmosphere.

17. The process cartridge according to claim 11, wherein a length of the first columnar portion in the axial direction is longer than a length of the first seal in the axial direction.

18. A process cartridge comprising:

a drum cartridge including a photosensitive drum; and a developing cartridge configured to be detachably mountable in the drum cartridge, the developing cartridge including a developing roller, a first seal, and a second seal, wherein the developing roller being in pressure contact with the photosensitive drum in a state where the developing cartridge is mounted in the drum cartridge, the developing roller extends in an axial direction, the developing roller comprising:

a hollow cylindrical rubber having an outer peripheral surface, the outer peripheral surface having one end and another end in the axial direction, the first seal contacting the one end of the outer peripheral surface of the hollow cylindrical rubber in a radial direction of the hollow cylindrical rubber and configured to capture toner deposited on the one end of the outer peripheral surface of the hollow cylindrical rubber, the second seal contacting the another end of the outer peripheral surface of the hollow cylindrical rubber in the radial direction and configured to capture toner deposited on the another end of the outer peripheral surface of the hollow cylindrical rubber;

a shaft extending in the axial direction through the hollow cylindrical rubber, the shaft including:

a first columnar portion;

a second columnar portion; and a middle portion provided between the first columnar portion and the second columnar portion in the axial direction, the middle portion having an outer diameter smaller than an outer diameter of the first columnar portion, and the outer diameter of the middle portion being smaller than an outer diameter of the second columnar portion;

a third columnar portion connected to the first columnar portion and provided on the opposite side of the middle portion with respect to the first columnar portion, the third columnar portion having an outer diameter equal to the outer diameter of the first columnar portion; and a fourth columnar portion connected to the second columnar portion and provided on the opposite side of the middle portion with respect to the second columnar portion, the fourth columnar portion having an outer diameter equal to the outer diameter of the second columnar portion, wherein an outer peripheral surface of the first columnar portion, an outer peripheral surface of the second columnar portion, and an outer peripheral surface of the middle portion are covered with the rubber, and an outer peripheral surface of the third columnar portion and an outer peripheral surface of the fourth columnar portion are exposed to an atmosphere, wherein a length of the first columnar portion in the axial direction is longer than a length of the first seal in the axial direction, wherein the first columnar portion, the second columnar portion, the third columnar portion, and the fourth columnar portion are made of metal, and wherein the first seal is arranged spaced apart from the third columnar portion in the radial direction and the second seal is arranged spaced apart from the fourth columnar portion in the radial direction.

* * * * *